US009822605B2

(12) United States Patent
Jerath

(10) Patent No.: US 9,822,605 B2
(45) Date of Patent: Nov. 21, 2017

(54) METHOD AND APPARATUS FOR CAPPING A SUBSEA WELLHEAD

(71) Applicant: Karan Jerath, Friendswood, TX (US)

(72) Inventor: Karan Jerath, Friendswood, TX (US)

( * ) Notice: Subject to any disclaimer, the term of this patent is extended or adjusted under 35 U.S.C. 154(b) by 0 days.

(21) Appl. No.: 15/488,381

(22) Filed: Apr. 14, 2017

(65) Prior Publication Data

US 2017/0298706 A1 Oct. 19, 2017

Related U.S. Application Data

(60) Provisional application No. 62/322,371, filed on Apr. 14, 2016.

(51) Int. Cl.

| | |
|---|---|
| ***E21B 33/035*** | (2006.01) |
| ***E21B 33/076*** | (2006.01) |
| ***E21B 43/01*** | (2006.01) |
| *E21B 33/068* | (2006.01) |
| *E21B 33/037* | (2006.01) |
| *E21B 33/038* | (2006.01) |
| *E21B 33/04* | (2006.01) |

(52) U.S. Cl.

CPC ..... *E21B 33/076* (2013.01); *E21B 33/035* (2013.01); *E21B 33/037* (2013.01); *E21B 33/038* (2013.01); *E21B 33/04* (2013.01); *E21B 33/068* (2013.01)

(58) Field of Classification Search

CPC .... E21B 33/035; E21B 33/037; E21B 33/038; E21B 33/043; E21B 33/064; E21B 33/076; E21B 43/0122

See application file for complete search history.

(56) References Cited

U.S. PATENT DOCUMENTS

| | | | | |
|---|---|---|---|---|
| 4,416,565 A * | 11/1983 | Ostlund | ..... | E21B 43/0122 210/170.11 |
| 4,531,860 A * | 7/1985 | Barnett | ..... | E21B 43/0122 210/923 |
| 8,522,881 B2 * | 9/2013 | Worrall | ..... | E21B 43/0122 166/304 |
| 9,062,808 B2 * | 6/2015 | Hyde | ..... | F16L 53/00 |

(Continued)

FOREIGN PATENT DOCUMENTS

| | | | | |
|---|---|---|---|---|
| GB | 2063776 A * | 6/1981 | ..... | E21B 43/0122 |
| GB | 2066095 A * | 7/1981 | ..... | E21B 43/0122 |

*Primary Examiner* — Matthew R Buck

(74) *Attorney, Agent, or Firm* — Taboada Law Firm, PLLC; John M. Taboada

(57) ABSTRACT

A method and apparatus for capping a subsea wellhead is disclosed, including channeling a heterogeneous mixture (HM) into an inlet riser; measuring an initial HM temperature; heating the HM; measuring the temperature of the HM post heating; passing the HM through a common port; passing the HM into an oil baffle chamber; monitoring the interphase of the HM in the oil baffle chamber; passing the HM into a water baffle chamber; monitoring the interphase of the HM in the water baffle chamber; controlling oil and water regulators to achieve substantially laminar flow and separation of the oil and water; heating the gas separated from the HM; measuring the temperature of the separated gas; measuring the density of the gas separated from the HM and if in the gas phase, opening a gas regulator to allow the gas to pass through the gas outlets. Other embodiments are described and claimed.

18 Claims, 13 Drawing Sheets

(56) References Cited

U.S. PATENT DOCUMENTS

Figure 1:
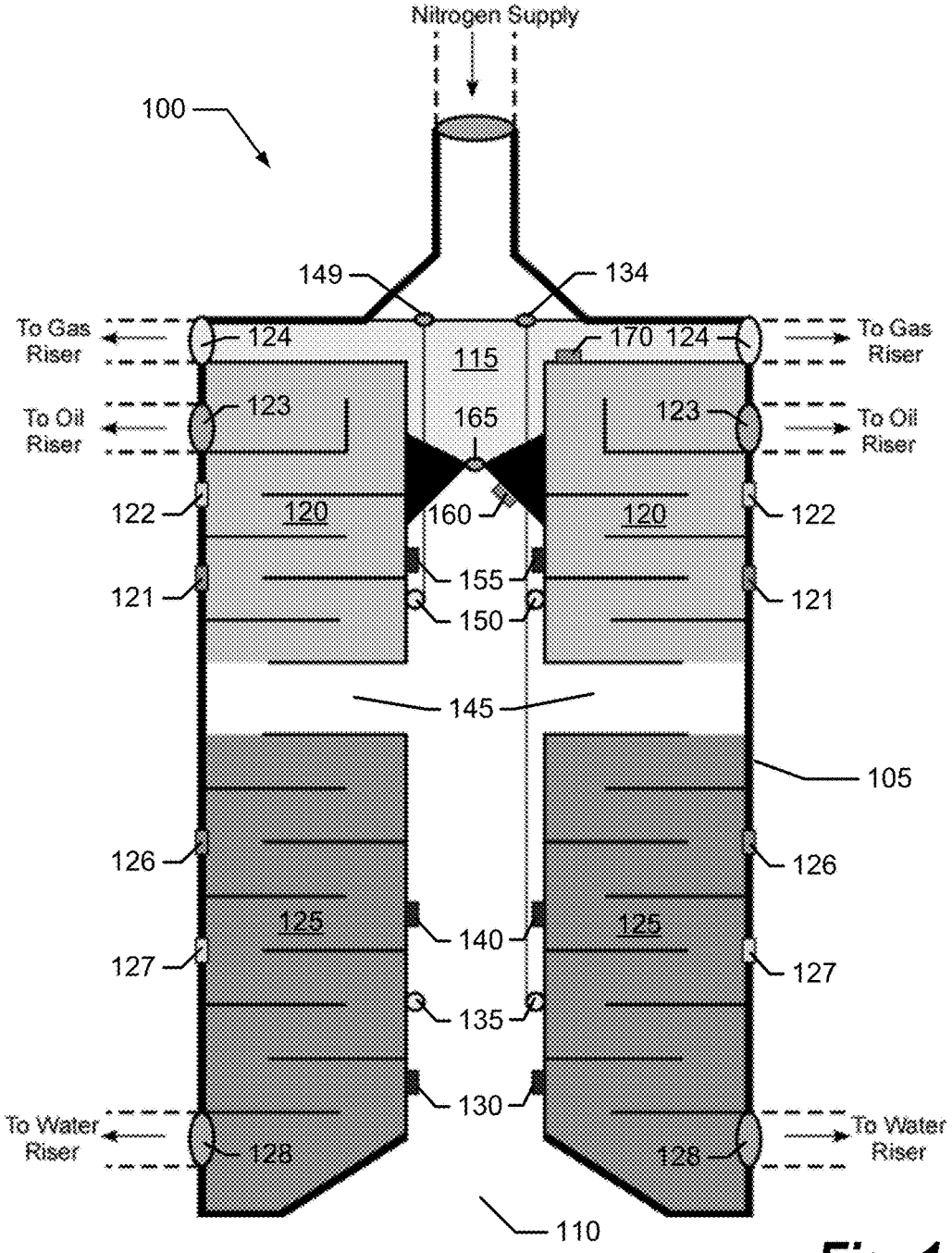

| | | | | |
|---|---|---|---|---|
| 9,488,038 | B2 * | 11/2016 | De Ghetto | E21B 43/36 |
| 9,506,327 | B2 * | 11/2016 | Vu | E21B 43/0122 |
| 9,587,467 | B2 * | 3/2017 | Vu | E21B 43/0122 |
| 2011/0315233 | A1 * | 12/2011 | Carter | E21B 43/0122 137/14 |
| 2012/0155964 | A1 * | 6/2012 | Carter | E21B 43/0122 405/60 |
| 2013/0046126 | A1 * | 2/2013 | Varney | B63B 35/32 588/260 |
| 2013/0177356 | A1 * | 7/2013 | Edmondson | E02B 15/046 405/60 |
| 2013/0183098 | A1 * | 7/2013 | Halal | E02B 15/045 405/60 |
| 2015/0247386 | A1 * | 9/2015 | Carlin | B01D 17/0211 210/747.5 |
| 2015/0300147 | A1 * | 10/2015 | De Ghetto | E21B 43/0122 210/787 |
| 2016/0160614 | A1 * | 6/2016 | Ward | E21B 43/0122 210/747.5 |

* cited by examiner

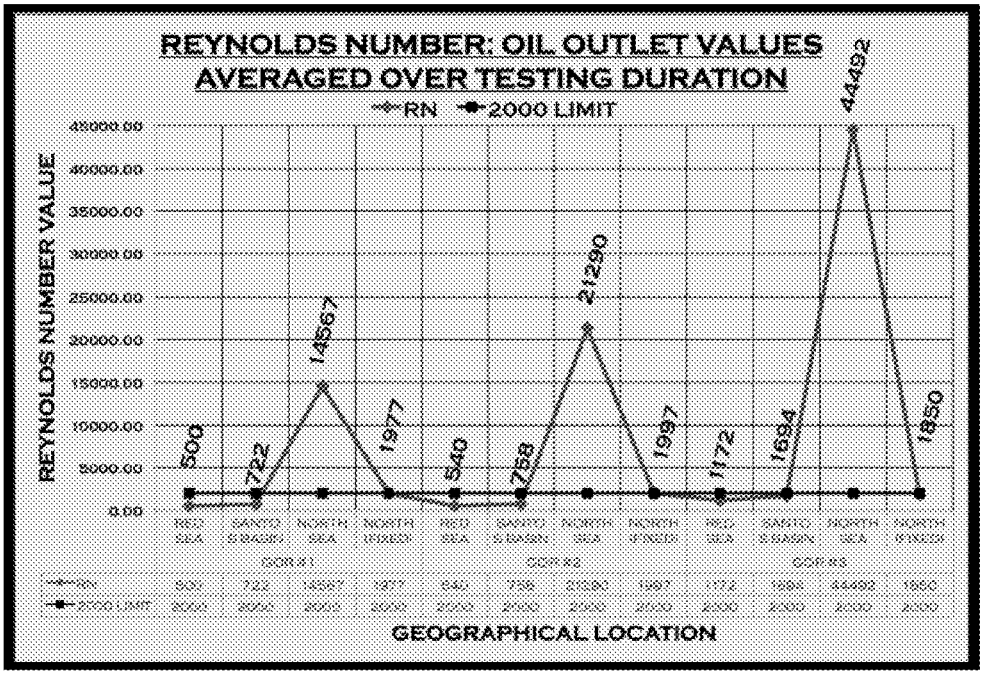
Fig. 2-A
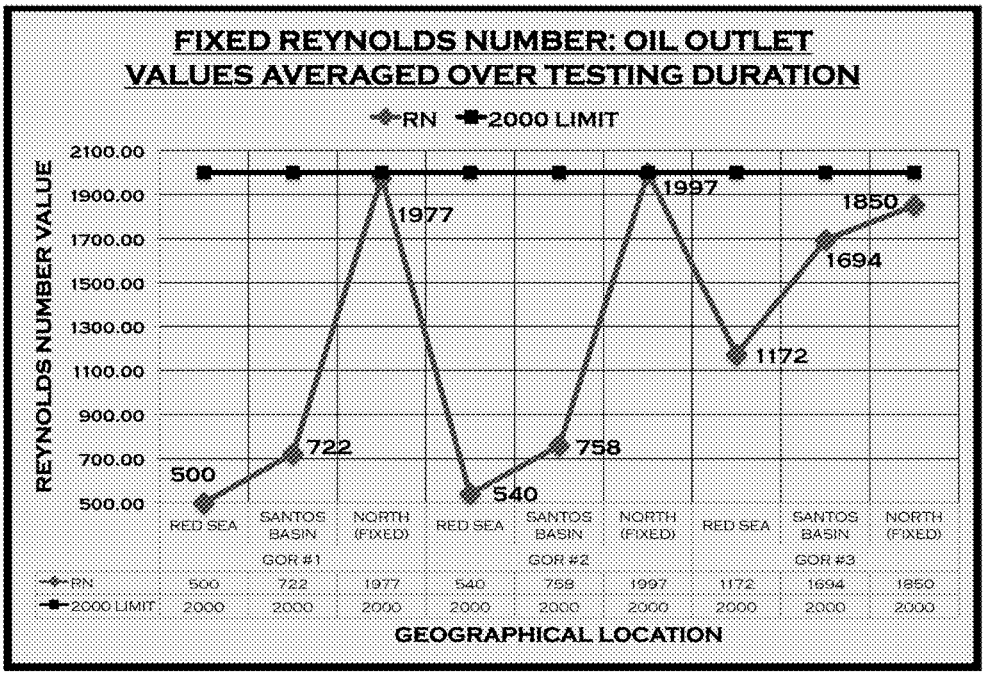
Fig. 2-B

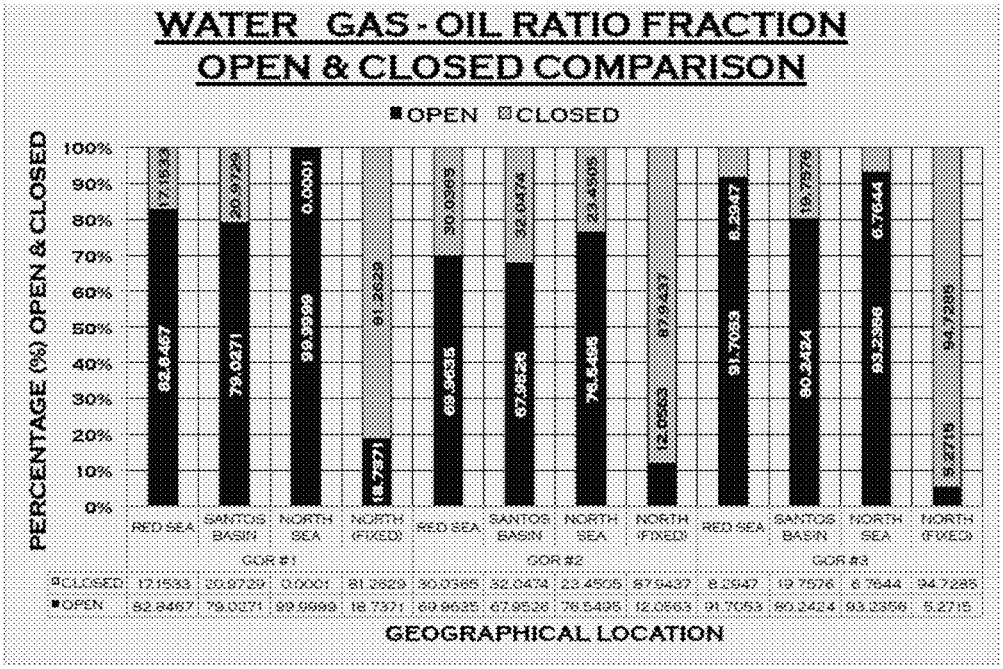
Fig. 2-C
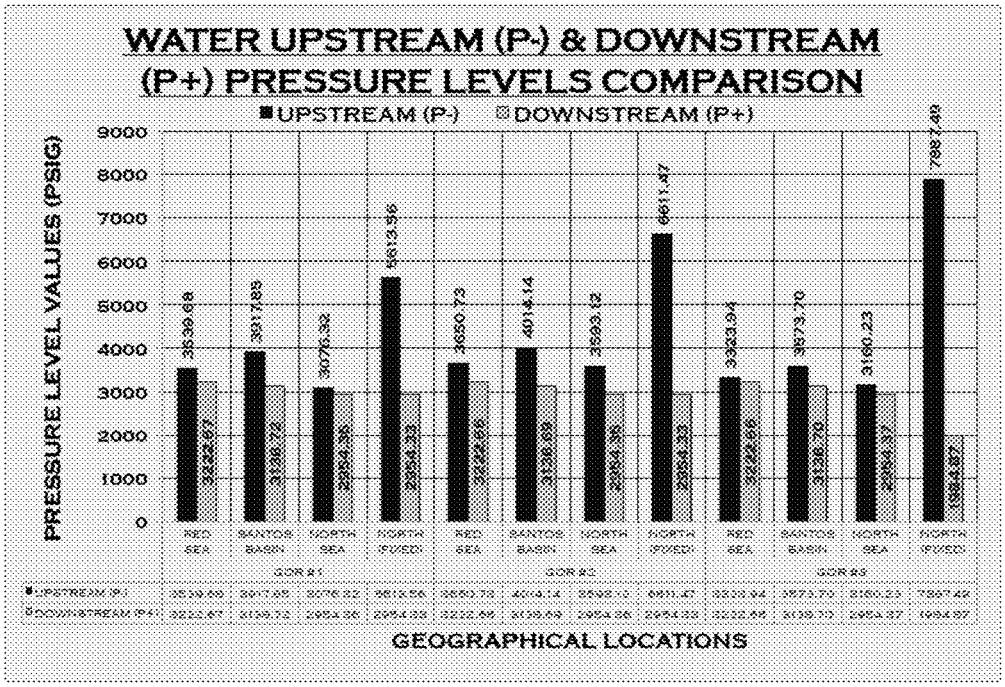
Fig. 2-D

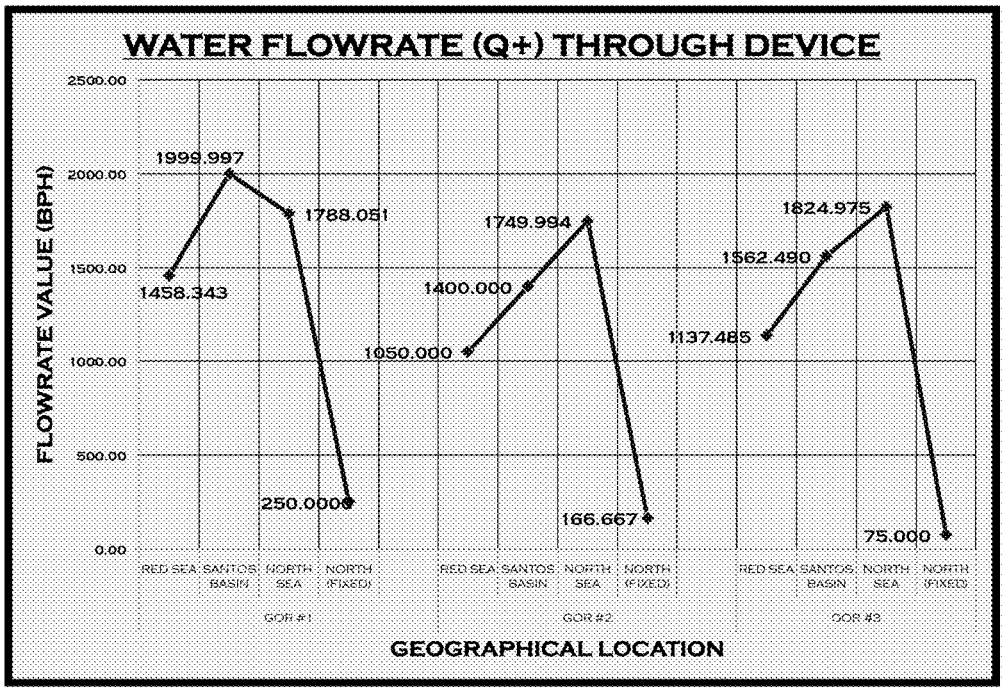
Fig. 2-E
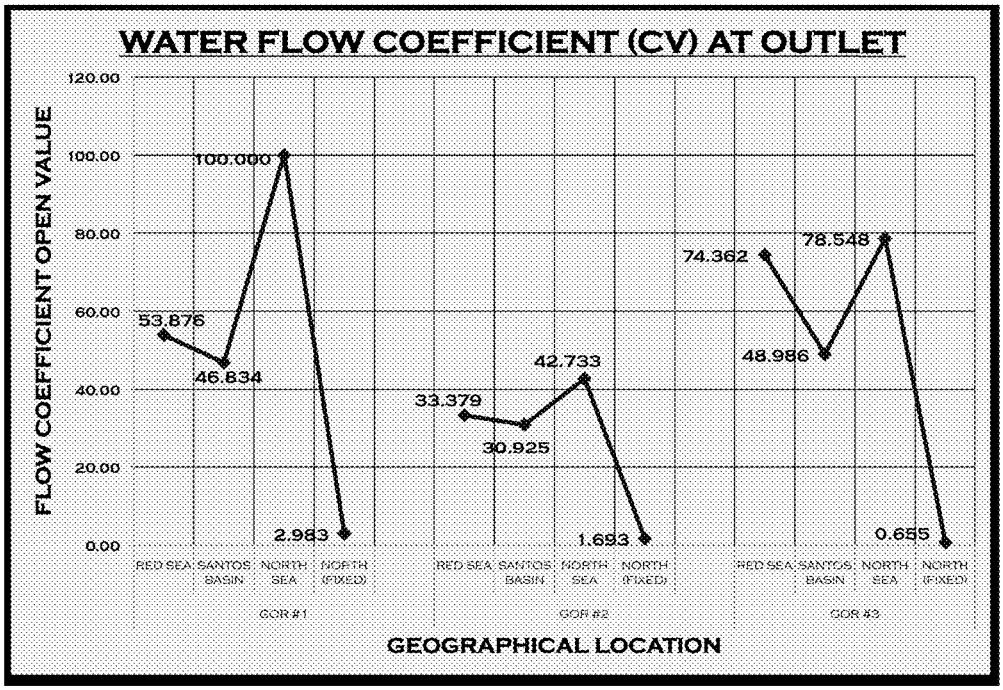
Fig. 2-F

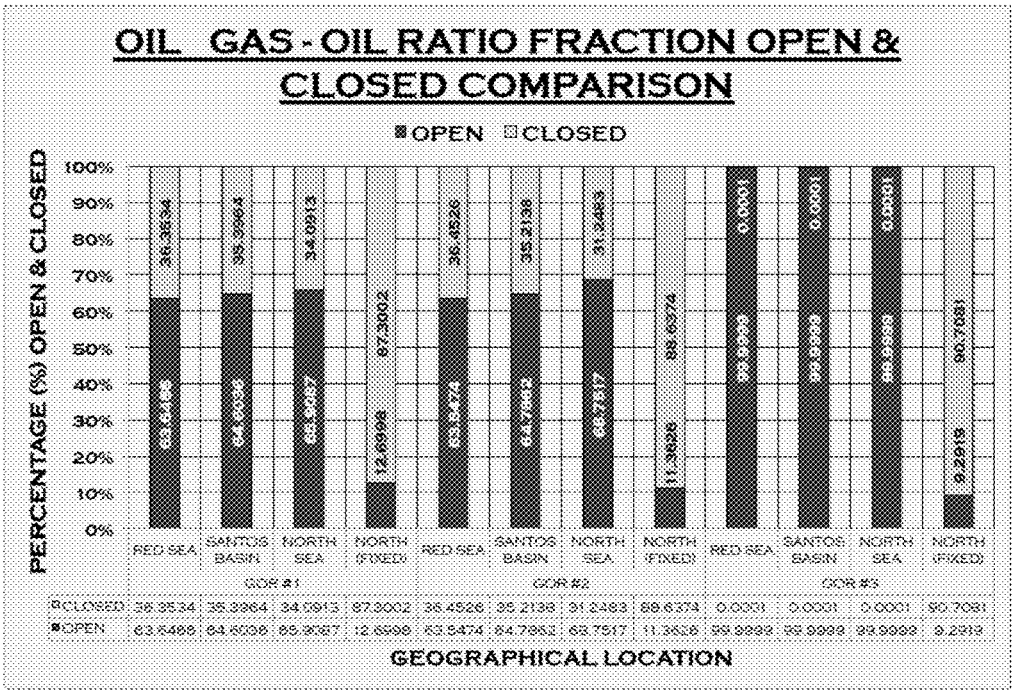
Fig. 2-G
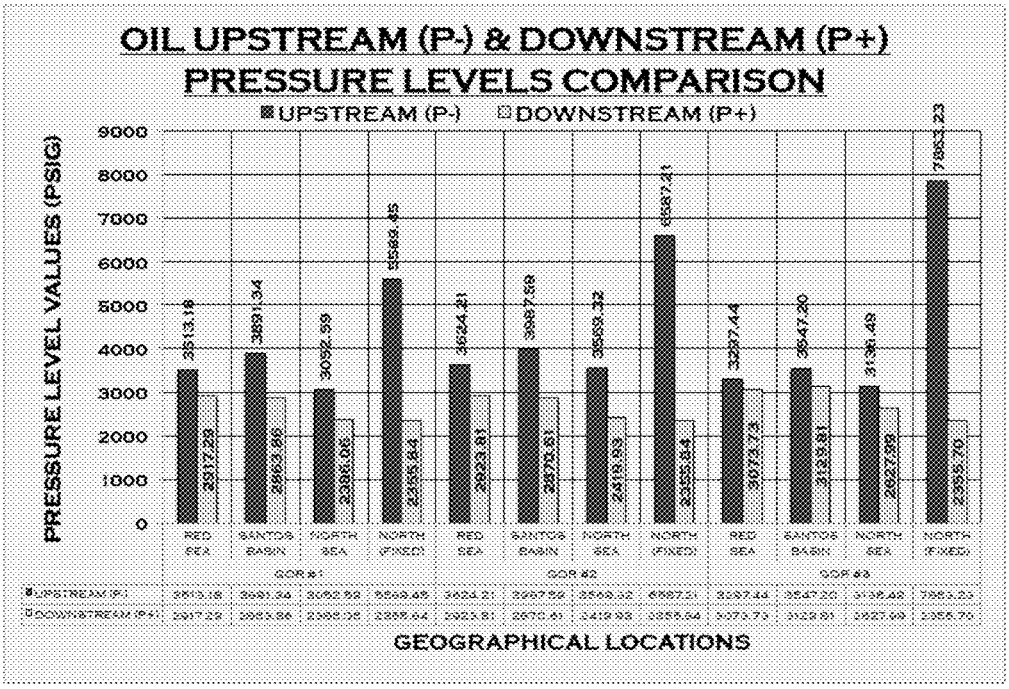
Fig. 2-H

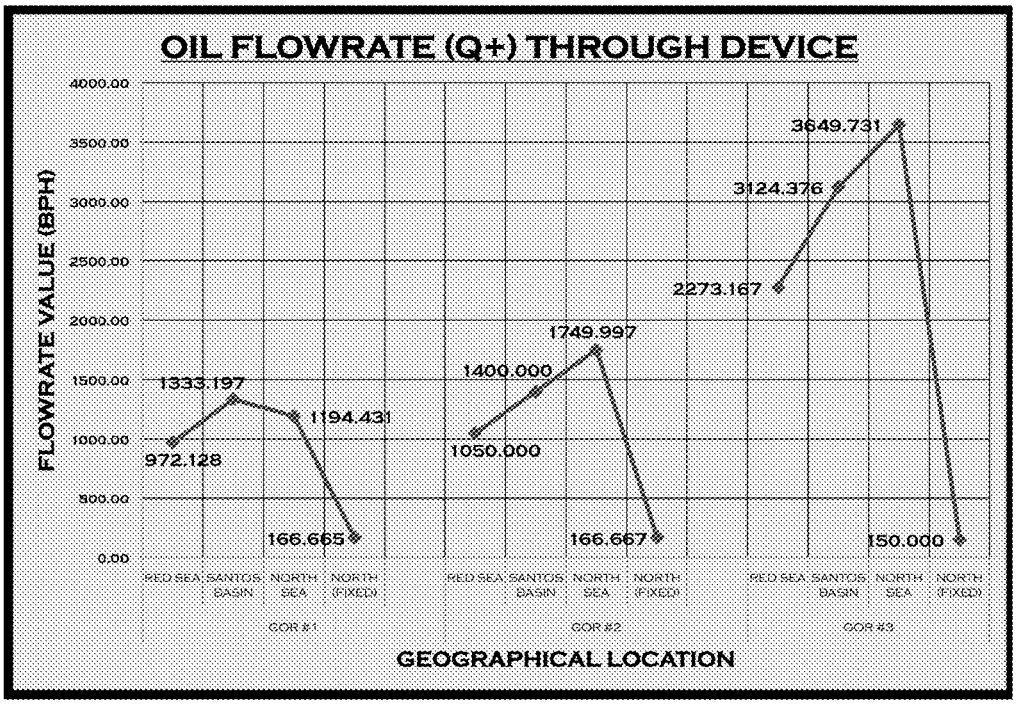
Fig. 2-I
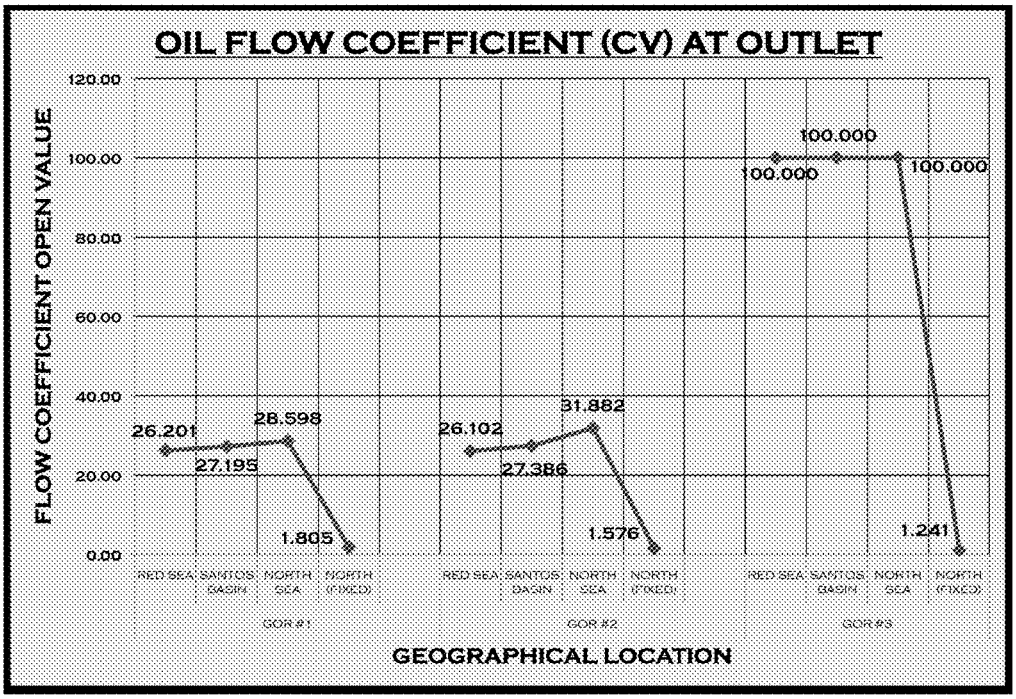
Fig. 2-J

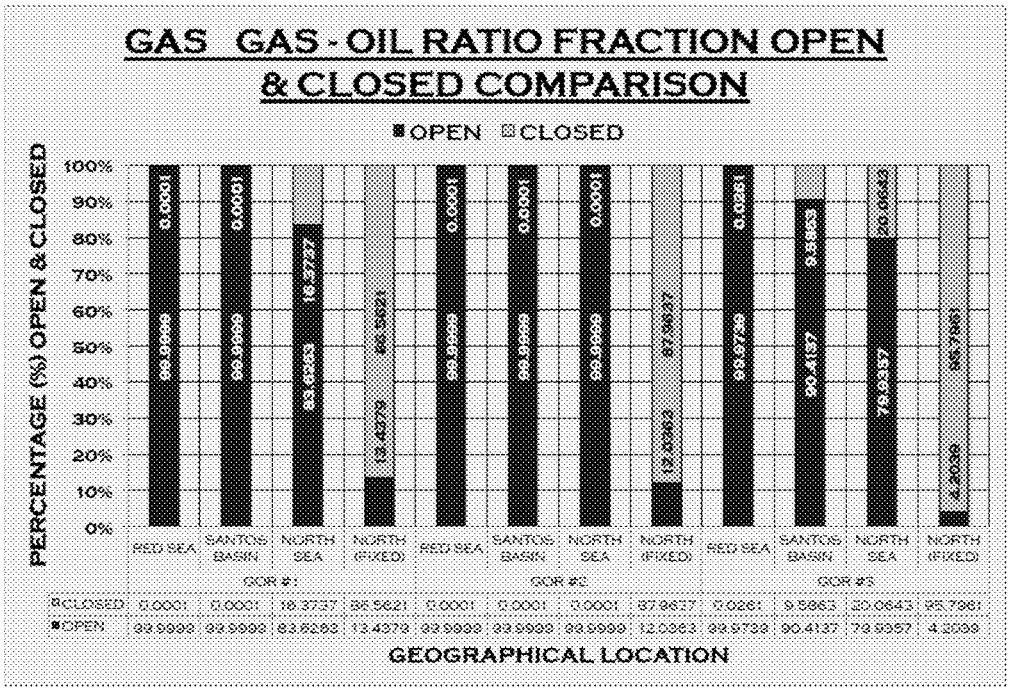
Fig. 2-K
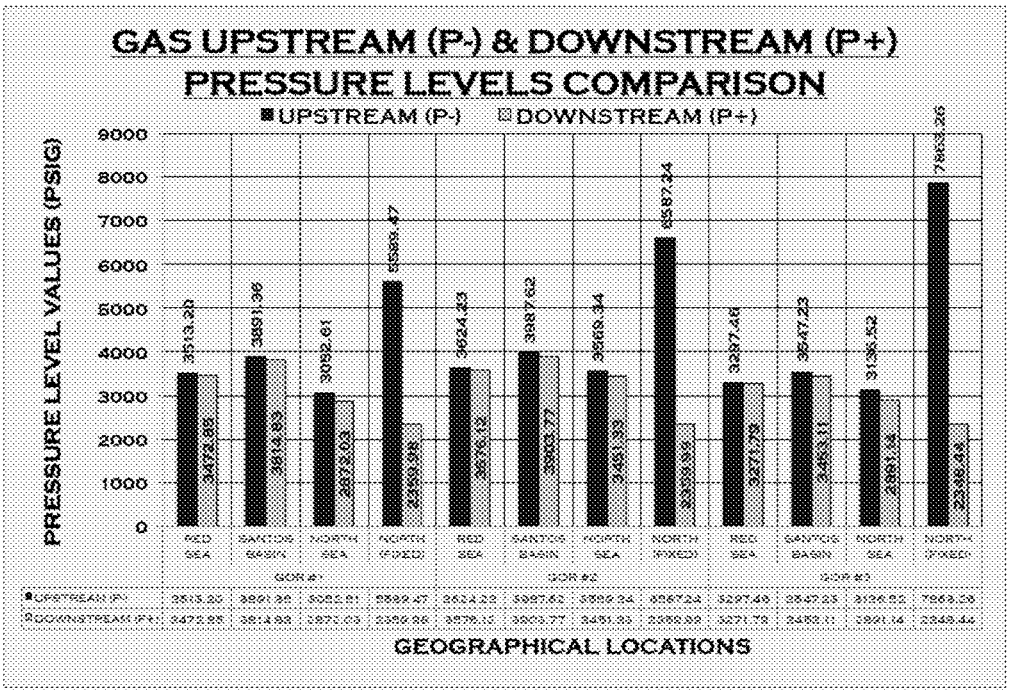
Fig. 2-L

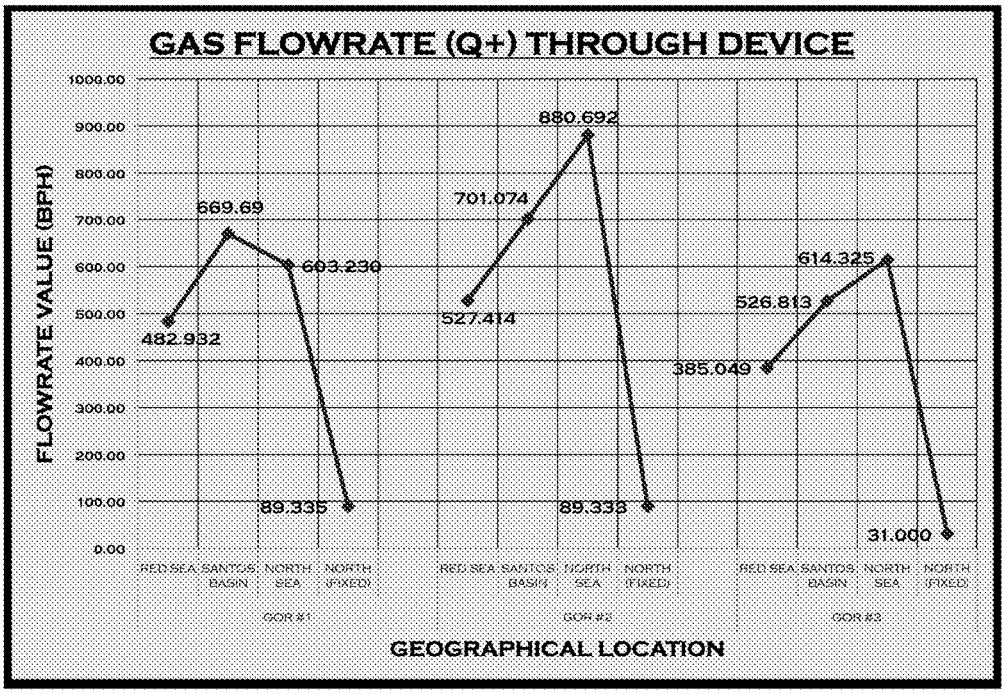
Fig. 2-M
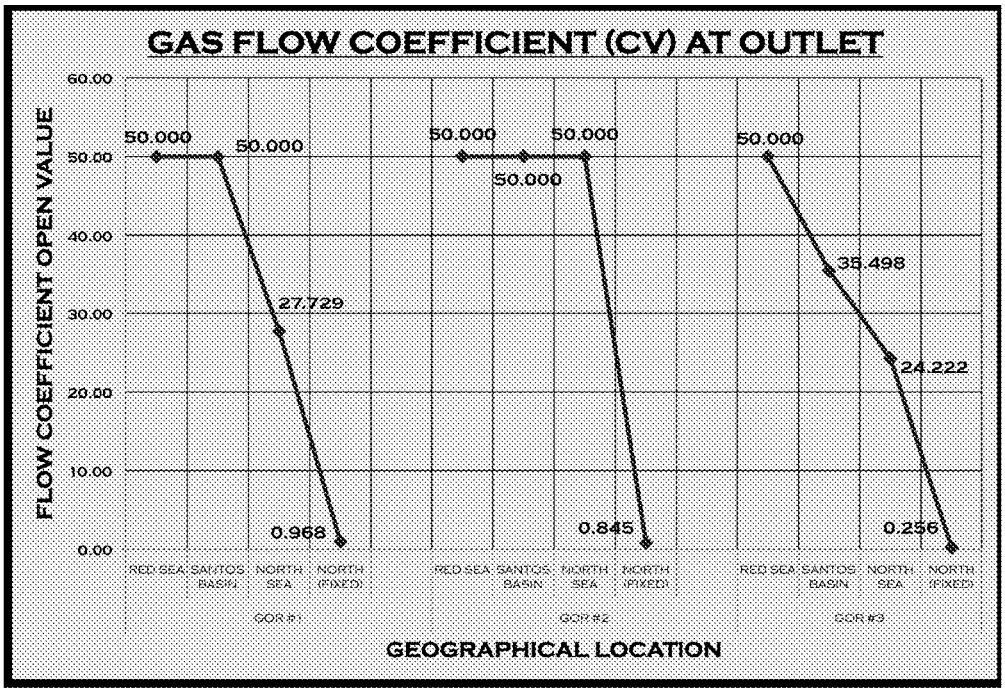
Fig. 2-N

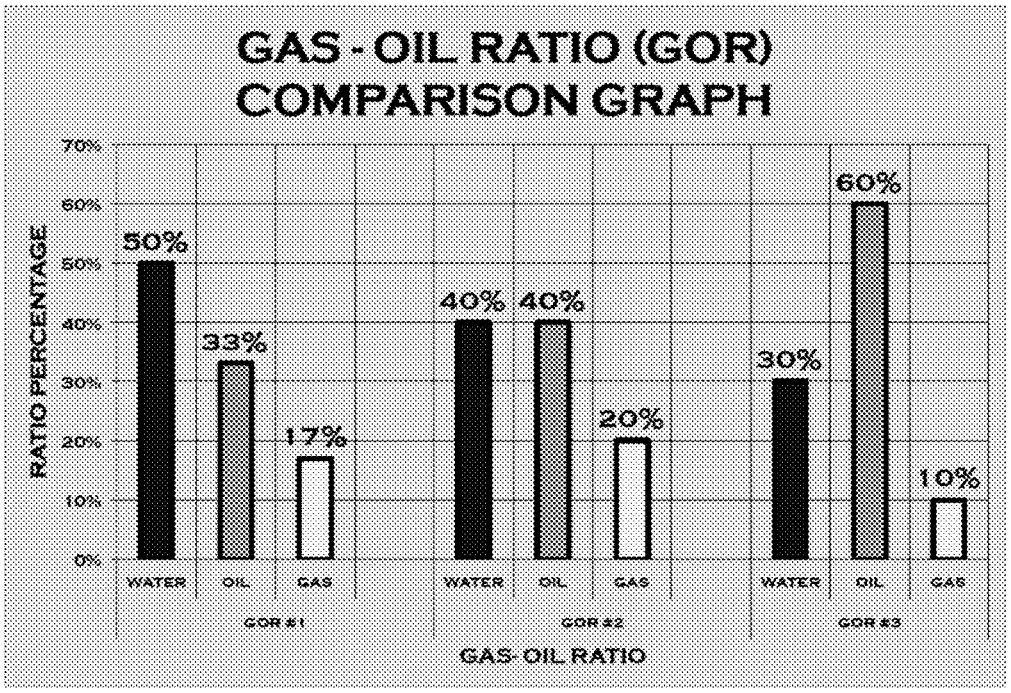
Fig. 2-O
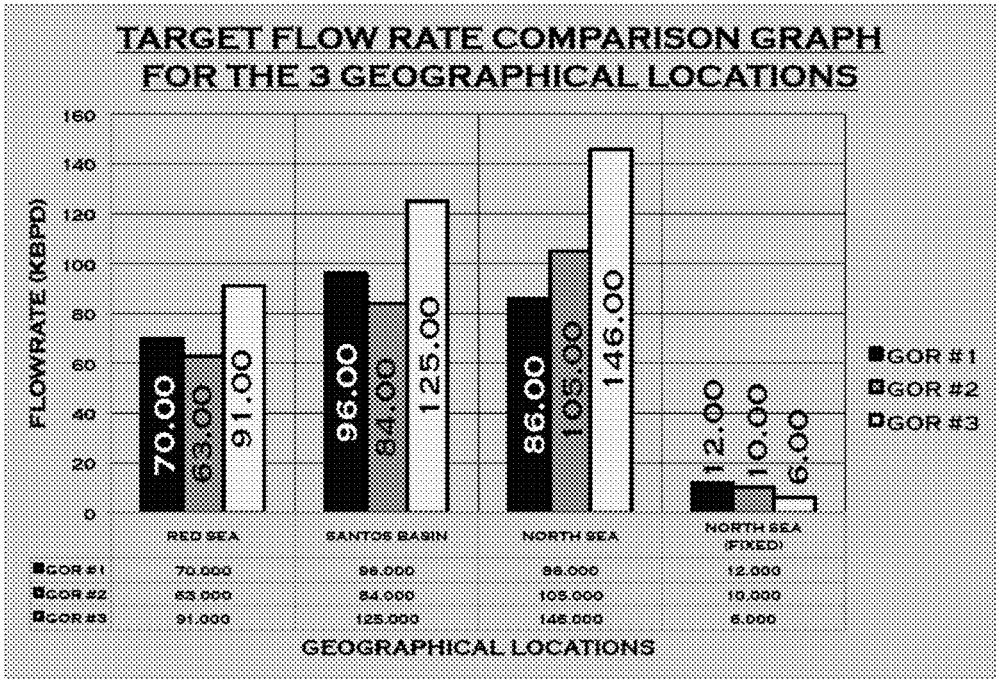
Fig. 2-P

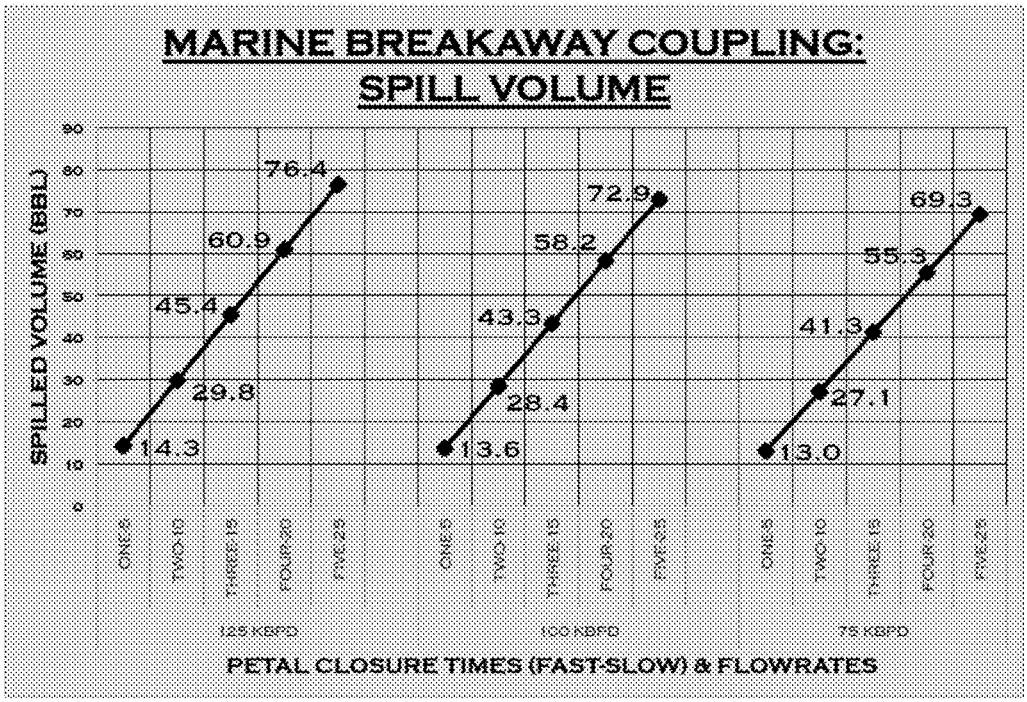
*Fig. 2-Q*
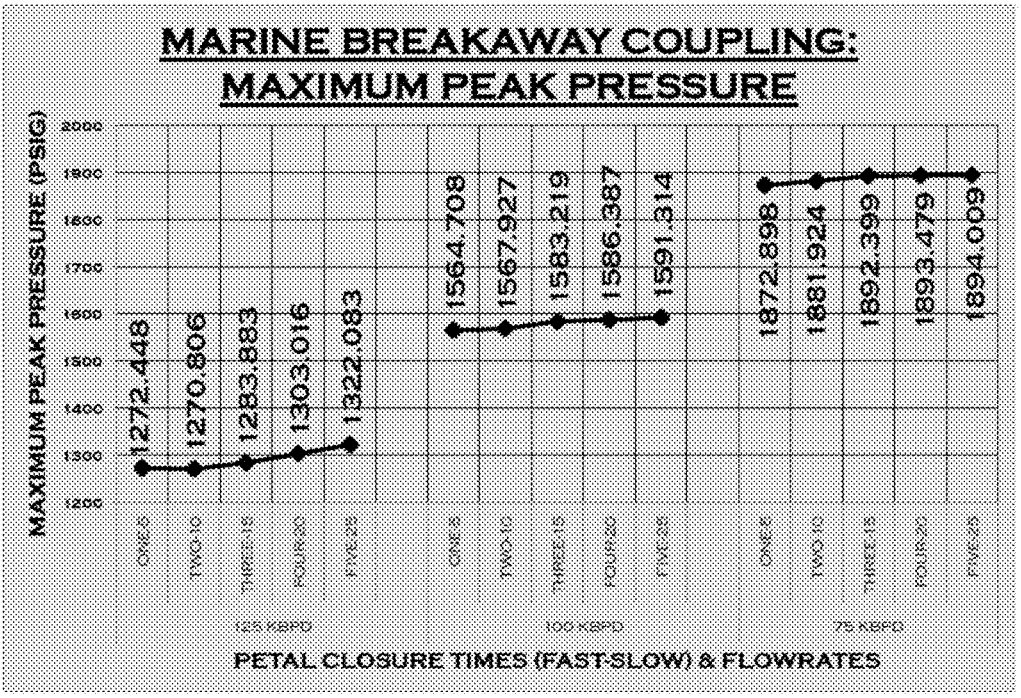
*Fig. 2-R*

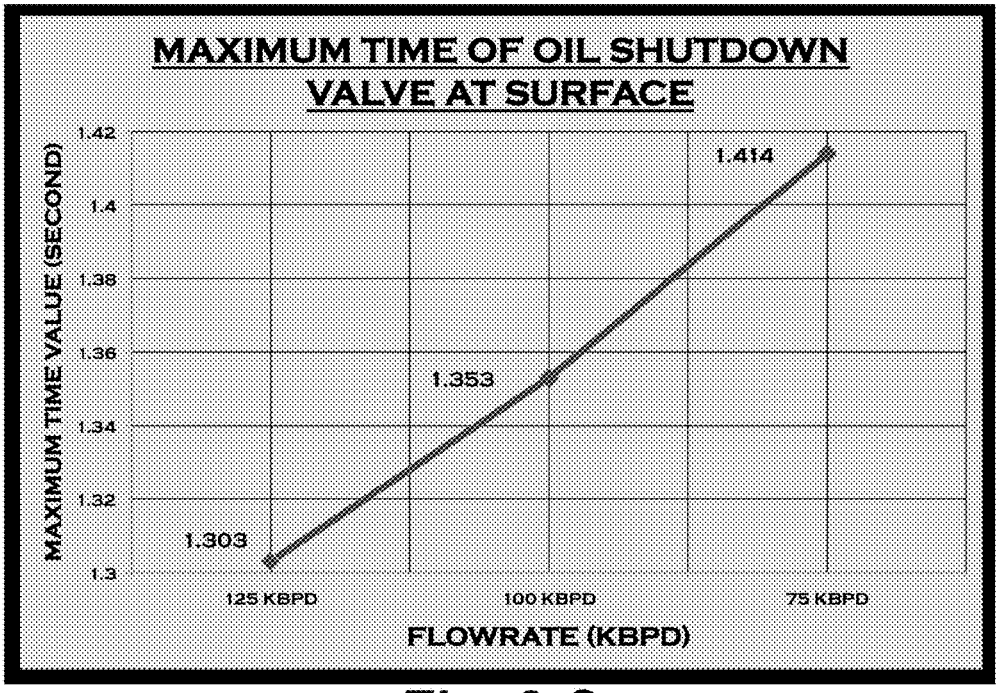
Fig. 2-S
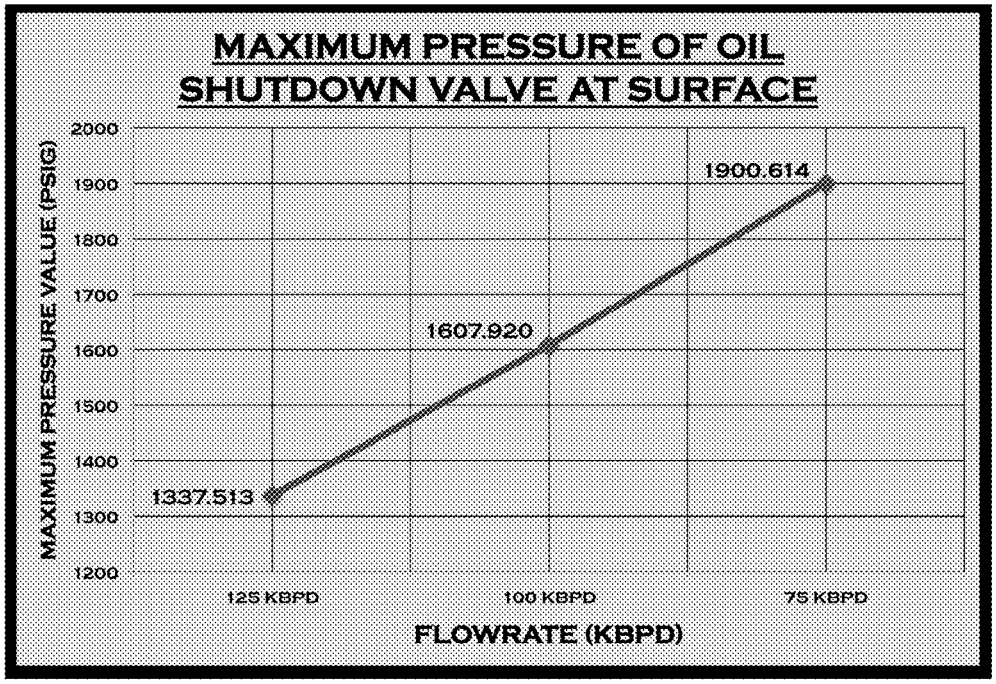
Fig. 2-T

| | Red Sea | Santos Basin | North Sea |
|---|---|---|---|
| Crude Type | Arabian Heavy (ABH) | Roncador Light (RCL) | Aasgard (ASGD) |
| Depth | 7254 Feet | 7065 Feet | 6650 Feet |
| | 2211.019 Meters | 2153.400 Meters | 2026.92 Meters |
| Pressure | 3238.18 PSI | 3154.14 PSI | 2969.73 PSI |
| | 3223.42 PSIG | 3139.44 PSIG | 2955.03 PSIG |
| Density | 27.7 | 28.5 | 47.6 |
| Specific Gravity | .8888 @60°F | .8844 @60°F | .7901 @60°F |
| Viscosity | SSU – 221.4 | SSU – 199.2 | SSU – 32.4 |
| | Cp – 42.49 | Cp – 37.92 | Cp – 1.956 |
| | Cs – 47.81 | Cs – 42.88 | Cs – 2.476 |
| VTMI | -.02209/F | -.02782/F | -.001912/F |
| Temperature Modulus | -3031°F | -3018°F | -2741.96°F |
| Bulk Modulus | 346889 PSI | 243616 PSI | 178167 PSI |
| Temperature | 4.4°C | 5.1°C | 8.0°C |
| | 39.92°F | 41.18°F | 46.40°F |

*Fig. 2-U*

METHOD AND APPARATUS FOR CAPPING A SUBSEA WELLHEAD

I. CROSS REFERENCE TO RELATED APPLICATIONS

This application claims the benefit of the filing date of U.S. Provisional Patent Application Ser. No. 62/322,371, filed on Apr. 14, 2016, entitled "Method and Apparatus for Capping a Subsea Wellhead," the entire disclosure of which is hereby incorporated by reference into the present disclosure.

II. BACKGROUND

The invention relates generally to collecting crude oil from a leaking subsea wellhead. More particularly, the invention relates to a novel method and apparatus for separating the oil, gas, and water at the subsea wellhead prior to bringing the oil, gas, and water up to the surface and into container and processing vessels.

III. SUMMARY

In one respect, disclosed is an apparatus for capping a subsea wellhead, the apparatus comprising: a housing having a bottom portion and a top portion; an inlet riser having an opening at the bottom portion of the housing and extending through the bottom portion of the housing and into the top portion of the housing, wherein the inlet riser is configured to channel a heterogeneous mixture of oil, gas, and water spewing from the subsea wellhead into the apparatus; a water baffle chamber within the bottom portion of the housing, wherein the water baffle chamber has one or more water chamber baffles, one or more water chamber density sensors, one or more water chamber pressure sensors, and one or more water outlets, wherein the one or more water chamber density sensors and the one or more water chamber pressure sensors monitor the interphase of the phases of the heterogeneous mixture in the water baffle chamber; an oil baffle chamber within the top portion of the housing, wherein the oil baffle chamber has one or more oil chamber baffles, one or more oil chamber density sensors, one or more oil chamber pressure sensors, and one or more oil outlets, wherein the one or more oil chamber density sensors and the one or more oil chamber pressure sensors monitor the interphase of the phases of the heterogeneous mixture in the oil baffle chamber; a common port between the bottom portion and the top portion of the housing, wherein the common port is configured to allow the oil access to the oil baffle chamber and to allow the water access to the water baffle chamber; a top chamber positioned above the oil baffle chamber and within the top portion of the housing, wherein the top chamber has one or more gas outlets; a gas regulator positioned between the top chamber and the inlet riser; a first set of one or more temperature sensors within the inlet riser configured to measure an initial temperature of the heterogeneous mixture entering the apparatus through the inlet riser; a first heater positioned above the first set of one or more temperature sensors and within the inlet riser, wherein the first heater is configured to raise the temperature of the heterogeneous mixture; a second set of one or more temperature sensors positioned above the first heater and within the inlet riser, wherein the second set of one or more temperature sensors are configured to measure the temperature of the heterogeneous mixture after being heated by the first heater; a second heater positioned above the common port and within the inlet riser, wherein the second heater is configured to heat the gas separated from the heterogeneous mixture; a third set of one or more temperature sensors positioned above the second heater and within the inlet riser, wherein the third set of one or more temperature sensors are configured to measure the temperature of the gas after being heated by the second heater; a first density sensor positioned below the gas regulator and within the inlet riser, wherein the first density sensor is configured to measure the density of the gas separated from the heterogeneous mixture; and a second density sensor within the top chamber, wherein the second density sensor is configured to measure the density of the gas which passes through the gas regulator to confirm that the gas is still in the gas phase prior to passing through the one or more gas outlets.

In another respect, disclosed is a method for capping a subsea wellhead, the method comprising: channeling a heterogeneous mixture of oil, gas, and water spewing from the subsea wellhead into an inlet riser of a housing having a bottom portion and a top portion; using a first set of one or more temperature sensors within the inlet riser to measure an initial temperature of the heterogeneous mixture; using a first heater within the inlet riser to heat the heterogeneous mixture channeled into the inlet riser; using a second set of one or more temperature sensors within the inlet riser to measure a post first heating temperature of the heterogeneous mixture to ensure heating of the heterogeneous mixture; passing the heterogeneous mixture through a common port between the bottom portion and the top portion of the housing; passing the heterogeneous mixture into an oil baffle chamber within the top portion of the housing, wherein the oil baffle chamber comprises one or more oil chamber baffles, one or more oil chamber density sensors, one or more oil chamber pressure sensors, one or more oil outlets, and one or more oil regulators coupled to the one or more oil outlets; using the one or more oil chamber density sensors and the one or more oil chamber pressure sensors to monitor the interphase of the phases of the heterogeneous mixture in the oil baffle chamber; passing the heterogeneous mixture into a water baffle chamber within the bottom portion of the housing, wherein the water baffle chamber comprises one or more water chamber baffles, one or more water chamber density sensors, one or more water chamber pressure sensors, one or more water outlets, and one or more water regulators coupled to the one or more water outlets; using the one or more water chamber density sensors and the one or more water chamber pressure sensors to monitor the interphase of the phases of the heterogeneous mixture in the water baffle chamber; using the monitoring of the interphase of the phases of the heterogeneous mixture to control the one or more oil regulators and the one or more water regulators to achieve substantially laminar flow and separation of the oil through the oil baffle chamber and the one or more oil regulators and the water through the water baffle chamber and the one or more water regulators; using a second heater within the inlet riser to heat the gas separated from the heterogeneous mixture to prevent crystallization of the gas; using a third set of one or more temperature sensors positioned above the second heater and within the inlet riser to measure the temperature of the gas after being heated by the second heater; using a first density sensor positioned below a gas regulator and within the inlet riser to measure the density of the gas separated from the heterogeneous mixture and if in the gas phase, opening the gas regulator to allow the gas to pass from the inlet riser to a top chamber having one or more gas outlets; and using a second density sensor within the top chamber to ensure the gas within the top chamber remains in the gas phase prior to allowing the gas to pass through the one or more gas outlets.

Numerous additional embodiments are also possible.

IV. BRIEF DESCRIPTION OF THE DRAWINGS

Other objects and advantages of the invention may become apparent upon reading the detailed description and upon reference to the accompanying drawings.

FIG. 1 is a cross sectional schematic representation of an apparatus for capping a subsea wellhead, in accordance with some embodiments.

FIGS. 2-A to 2-U are graphs of simulations of the apparatus for capping a subsea wellhead, in accordance with some embodiments.

Figure 3:
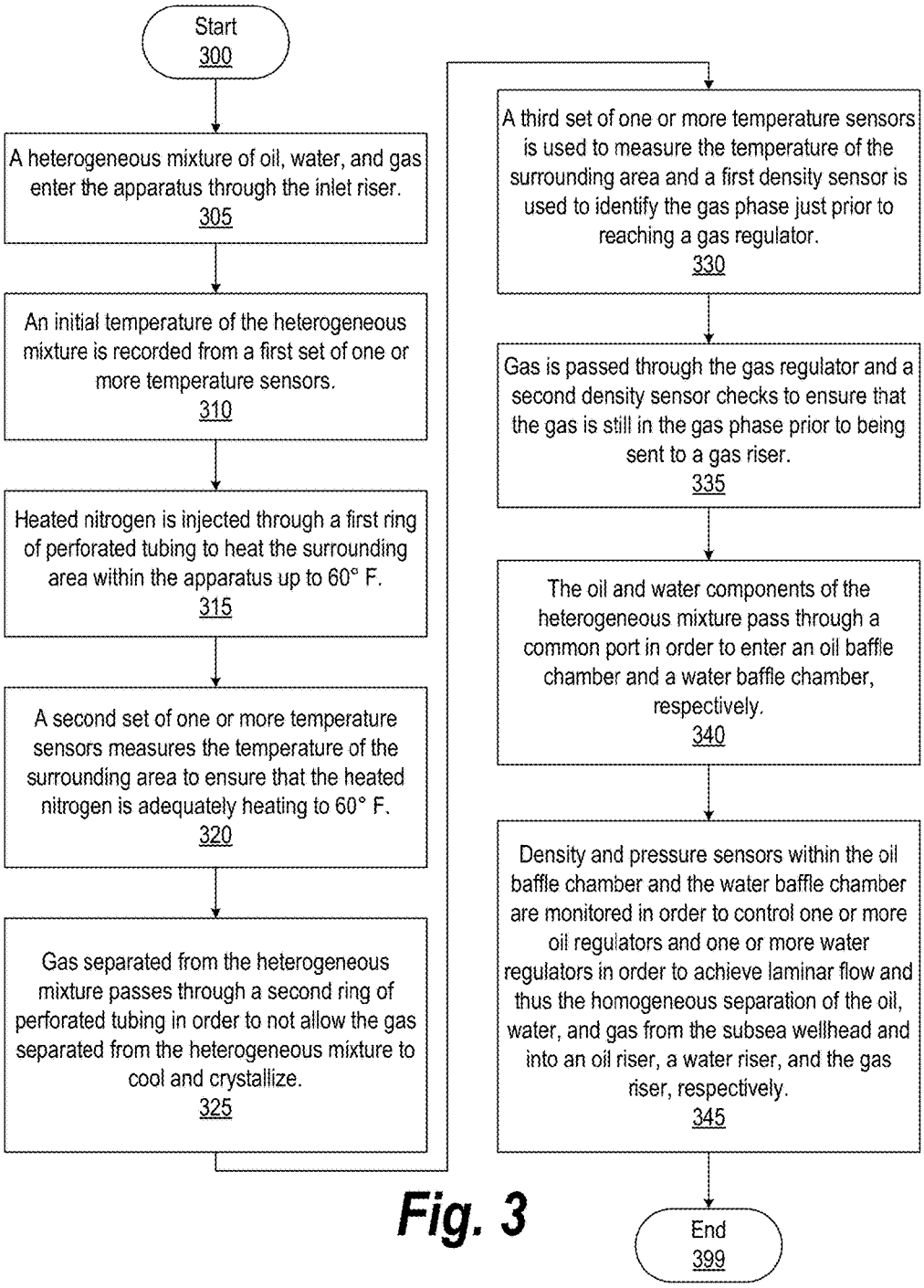

FIG. 3 is a block diagram illustrating a method for capping a subsea wellhead, in accordance with some embodiments.

While the invention is subject to various modifications and alternative forms, specific embodiments thereof are shown by way of example in the drawings and the accompanying detailed description. It should be understood, however, that the drawings and detailed description are not intended to limit the invention to the particular embodiments. This disclosure is instead intended to cover all modifications, equivalents, and alternatives falling within the scope of the present invention as defined by the appended claims.

V. DETAILED DESCRIPTION

One or more embodiments of the invention are described below. It should be noted that these and any other embodiments are exemplary and are intended to be illustrative of the invention rather than limiting. While the invention is widely applicable to different types of systems, it is impossible to include all of the possible embodiments and contexts of the invention in this disclosure. Upon reading this disclosure, many alternative embodiments of the present invention will be apparent to persons of ordinary skill in the art.

On Apr. 20, 2010, the Gulf of Mexico experienced one of the most devastating environmental situations after the explosion of the Deepwater Horizon, an ultra-deepwater oil drilling ring operated by BP. The rig was 42 miles off the coast of Louisiana and 1 mile deep. By the time it was capped on Jul. 15, 2010, an estimated 5 million barrels of oil had leaked into the Gulf. The problem with shutting down the well, with a cofferdam container cap, as soon as the rig exploded lay in the failure of the blowout preventer to respond to electronic commands from onboard ships at sea. Due to the unexpected intensity of the flow rate, the cofferdam device was not able to function at its optimal level. The methane gas being brought up with the crude oil began to form hydrates, which solidified into crystals towards the opening of the pipe, prohibiting the intended oil to access the container ship at the surface. The heating capabilities were also not able to produce the intended results, leading to the device failing to operate. Another problem lay in the handling of oil, gas, and water. If collected, for the majority of the time, the oil is disposed by means of incineration due to prolonged mixture with the water after skimmed from the surface through the guidance from the local fisherman that were hired from BP. Fragile marine ecosystems above and under the water such as mangrove forests, wetlands, and coral reefs could use their fibrous plant materials to absorb the oil and eventually damage the surroundings, making it inhabitable for all life. The universal symbol for an oil spill is practically a seabird coated in the dark brown viscous liquid, which leaves them prone to hypothermia, but it is not just the birds that suffer through this excruciating pain. Marine species such as dolphins, seals, and turtles are all negatively impacted as they indirectly consume oil through their primary diets. Humans are also directly and indirectly affected. While direct issues such as jobs are substantially reduced through economic devastation, it is the indirect impacts that prove to be the most damaging to us. Because oil is semi-volatile, it can evaporate in the air and stay near the ground where it is in the "breathing zone." Through wind, these tiny hydrocarbon droplets called Volatile Organic Compounds (VOCs) can end up in the respiratory system where side effects such as vomiting, nausea, headaches, and worst of all cancer can occur. BP tried countless times for remediation under pressure from many governmental agencies to stop the ongoing flow, and one of the most controversial methods to this day includes the usage of COREXIT, a toxic dispersant. While the full complications and repercussions from the Deepwater Horizon are unknown to this day, there have been countless complaints by the citizens of the Gulf coast due to the problematic side effects.

The embodiment or embodiments described herein solve these problems and others by proposing a new method and apparatus for separating the oil, gas, and water at the subsea wellhead prior to bringing the oil, gas, and water up to the surface and into container and processing vessels.

FIG. 1 is a cross sectional schematic representation of an apparatus for capping a subsea wellhead, in accordance with some embodiments.

In some embodiments, an apparatus for capping a subsea wellhead 100 comprises a cylindrically shaped housing 105 made from carbon steel, an inlet riser 110, a top chamber 115, an oil baffle chamber 120, a water baffle chamber 125, perforated tubing rings, pressure sensors, density sensors, temperature sensors, and regulators. The apparatus is an open system where the surrounding atmosphere is similar to the one within the apparatus. In operation, the apparatus is placed over a leaking wellhead once a subsea spill has been detected. Once positioned over the leaking wellhead, the heterogeneous mixture of oil, gas, and water enter the apparatus 100 through the inlet riser 110. As the heterogeneous mixture enters the apparatus, a first set of one or more temperature sensors 130 measure an initial temperature of the heterogeneous mixture. A first ring of perforated tubing 135 is positioned above the first set of one or more sensors 130. Heated nitrogen, regulated by a first nitrogen regulator 134, is injected through the first ring of perforated tubing 135 to heat the surrounding area within the apparatus up to 60° F. Next, a second set of one or more temperature sensors 140 measures the temperature of the surrounding area to ensure that the heated nitrogen is adequately heating to 60° F. Above the second set of one or more temperature sensors 140, a common port 145 for oil and water allows access to the oil baffle chamber 120 and the water baffle chamber 125. Ultimately, the gas phase exits through the top chamber 115 and the water and oil phases enter their respective baffle chambers 125, 120. Above the common port 145, a second ring of perforated tubing 150 is positioned so as to permit the injection of heated nitrogen, regulated by a second nitrogen regulator 149, in order to not allow the gas separated from the heterogeneous mixture to cool and crystallize. In some embodiments, the first ring of perforated tubing 135 and the second ring of perforated tubing 150 are supplied through a single nitrogen regulator. Next, a third set of one or more temperature sensors 155 is used to measure the temperature of the surrounding area and a first density sensor 160 is used to identify the gas phase just prior to reaching the gas regulator 165. The gas regulator leads to the top chamber 115 where a second density sensor 170 checks to ensure that the gas is still in the gas phase prior to being sent through one or more gas outlets of the top chamber to one or more gas risers. The one or more gas risers may comprise a marine flex hose(s) coupled to the output valve(s) 124 of the top chamber 115 and are used to transport the gas into a surface vessel for containment.

The oil baffle chamber 120 comprises five baffles and within the baffles there are one or more density sensors 121 and pressure sensors 122 which monitor the interphase of the phases. The water baffle chamber 125 comprises seven baffles and within the baffles there are one or more density sensors 126 and pressure sensors 127 which monitor the interphase of the phases. The data received from the sensors 121, 122, 126, 127 is used to adjust the one or more oil regulators 123 and the one or more water regulators 128 depending on the composition of the phases entering the apparatus. Oil passing through the one or more oil regulators 123 is sent to an oil riser. The oil riser may comprise a marine flex hose(s) coupled to the output valve(s) of the oil baffle chamber 120 and is used to transport the oil into a surface vessel for containment. Water passing through the one or more water regulators 128 is sent to either the surrounding sea water or to a water riser. The water riser may comprise a marine flex hose(s) coupled to the output valve(s) of the water baffle chamber 125 and is used to transport the water into a surface vessel for containment. For example, if there is too much oil in the water section of the baffle, the outlet regulators for the oil will open to a larger percentage in order to compensate for the larger concentration of oil entering the apparatus 100 through the inlet riser 110. This feedback mechanism permits the apparatus to self-monitor and to achieve laminar flow, but humans may also intervene to override the regulator settings. Once one of the regulators, either gas, oil, or water, hit 100% open, then this is the maximum flow rate that the apparatus may handle while assuring complete homogenous separation.

In some embodiments, the apparatus 100 has a height of 75 feet and a diameter of 42 feet. The diameter of the inlet riser 110 at the bottom of the apparatus is 30 feet. The first set of one or more temperature sensors 130 is located approximately 10 feet from the bottom of the apparatus. The first ring of perforated tubing 135 is located approximately located 14 feet from the bottom of the apparatus. The second set of one or more temperature sensors 140 is located approximately 24 feet from the bottom of the apparatus. The second ring of perforated tubing 150 is located approximately located 53 feet from the bottom of the apparatus. The third set of one or more temperature sensors 155 is located approximately 57 feet from the bottom of the apparatus. The first density sensor 160 is located approximately 60 feet from the bottom of the apparatus. The gas regulator 165 is located approximately 64 feet from the bottom of the apparatus. The second density sensor 170 is located approximately 70 feet from the bottom of the apparatus. The output valve(s) of the top chamber 115 have a diameter of approximately 4.5 ft.

In some embodiments, the apparatus 100 has a common port 145 located approximately 46 feet from the bottom of the apparatus. The common port 145 has a height of approximately 12 feet. The oil baffle chamber 120 extends from approximately 49 feet to approximately 71 feet from the bottom of the apparatus. The baffle chambers of the oil baffle chambers 120 have a height of approximately 3.5 feet and a length of approximately 5 feet. The one or more outputs of the oil baffle chamber 120 have a diameter of approximately 8.5 feet. The one or more density sensors 121 are located approximately 57 feet from the bottom of the apparatus and the one or more pressure sensors 122 are located approximately 62 feet from the bottom of the apparatus. The water baffle chamber 125 extends from approximately 0 feet to approximately 38 feet from the bottom of the apparatus. The baffle chambers of the water baffle chambers 125 have a height of approximately 4.75 feet and a length of approximately 5 feet. The one or more outputs of the water baffle chamber 125 have a diameter of approximately 10.75 feet. The one or more density sensors 126 are located approximately 28 feet from the bottom of the apparatus and the one or more pressure sensors 127 are located approximately 24 feet from the bottom of the apparatus.

FIGS. 2-A to 2-U are graphs of simulations of the apparatus for capping a subsea wellhead, in accordance with some embodiments.

Simulations for the apparatus with the disclosed dimension were conducted using Stoner Pipeline Software (SPS) for three geographical locations, the Red Sea, Santos Basin, and the North Sea as shown in FIG. 2-C, FIG. 2-D, FIG. 2-E, FIG. 2-F, FIG. 2-G, FIG. 2-H, FIG. 2-I, FIG. 2-J, FIG. 2-K, FIG. 2-L, FIG. 2-M, and FIG. 2-N. Each location was specifically selected for not only the magnitude of crude oil currently being extracted, but also for the expected development in the next 10-20 years in the region. With expansion occurring both horizontally and vertically, the amount of human error increases and in turn may result in a spill. By having tested these areas, data can be generated to determine how the disclosed apparatus handles the situation given the properties of the region. The Red Sea site was simulated with a crude type of Arabian Heavy (ABH) at a depth of 7,254 feet and a viscosity of 42.49 centiPoise. The Santos Basin site was simulated with a crude type of Roncador Light (RCL) with a depth of 7,065 feet and a centiPoise value of 37.92. And finally, the North Sea location was simulated with Aasgard (ASGD) as the crude type with a maximum depth of 6,650 feet and 1.956 centiPoise value. These and other parameters used in the simulation are shown in FIG. 2-U. A total of 3 simulations for each of the sites were conducted using 3 different Gas-Oil Ratios (GOR). The GORs used were listed in order of Water-Oil-Gas. It included 50-33-17 (GOR #1), 40-40-20 (GOR #2), and 30-60-10 (GOR #3) as illustrated in FIG. 2-O along with the target flow rates for the three sites at the 3 different GOR values shown in FIG. 2-P. The first test was the parametric study, where the device was set to run given the fluid properties. From this, the maximum flow rate was determined until one of the GOR values reached 99.9999% in the fraction open sector of the outlet valves. Likewise, the Reynolds number, which is a test for the turbidity, had to remain below 2000 (the value for laminar flow) as shown in FIG. 2-A and FIG. 2-B. Achieving laminar flow ensures 100% separation into homogenous mixtures. The downstream and upstream pressures were recorded to ensure that reverse flow was not occurring. The pressure remained slightly higher in the device so that the flow path of oil and gas was always heading up to the surface. Due to this hydraulic condition, the water outlet was able to discharge back into the sea. The simulation was stopped when Steady State Operation was achieved. This occurs when the device is functioning without any disturbances or any irregular changes, thus substantiating reliability and functionality. The formation of methane hydrates was eliminated by injecting a small percentage of Nitrogen gas into the apparatus through the perforated tubes as the three phases entered. The second test was conducted showing the process of a shutdown in the event of a failure, FIG. 2-S and FIG. 2-T. The maximum surge peak pressure was the main focus to assure no unintended oscillation would disrupt the process or damage the apparatus in the process. It is necessary to test for this as internal errors may occur in such environments. This will show manufacturers interested in implementing the device how the device handles such scenarios. Only the Santos Basin was selected for this test as the concept holds true for any geographical site. Likewise, the Santos Basin had the greatest range in flow rates for the 3 Gas-Oil Ratios. The final test was for the Marine Breakaway Coupling (MBC), FIG. 2-Q and FIG. 2-R. This device is primarily used when transferring the separated crude oil from the marine flex-hose into the vessel. In events such as large waves, crude oil is typically spilled due to the connection breaking apart. The MBC on the other hand, closes its petals at different rates, thus allowing the flow rate to be stopped, preventing the spill. In this simulation, the closing rates simulated for the petal closure ranged from 1 to 5 seconds for the 4 fast petals and 5-25 seconds in increments of 5 for the other 4 slow petals. Once again the Santos Basin was used for the simulations because the concept remains the same and because of the location has the largest range of flow rates. Throughout the simulation, it was noticed that the North Sea was not providing a reasonable Reynolds Number. The value, which should have been below 2000, was well over 30,000 and so to continue to provide realistic results for the site, the flow rate was reduced until the Reynolds number was slightly below 2000. The results for this situation were recorded as North Sea (Fixed) and used as a comparison to show how the properties for the North Sea do not work well with the disclosed geometry of the apparatus. The crude oil is too light and would require a larger device to handle the flow rate. While the apparatus is able to contain the flow, the intended purpose of separating the phases into homogeneous mixtures does not occur. With these 3 simulations, the apparatus was able to ultimately cope with the given situations guaranteeing functionality and reliability once again.

FIG. 3 is a block diagram illustrating a method for capping a subsea wellhead, in accordance with some embodiments. In some embodiments, the method illustrated in FIG. 3 may be performed by one or more of the devices illustrated and simulated in FIG. 1 and FIGS. 2-A to 2-U. Processing begins at 300 whereupon, at block 305 a heterogeneous mixture of oil, water, and gas enter the apparatus through the inlet riser. At block 310, an initial temperature of the heterogeneous mixture is recorded from a first set of one or more temperature sensors. At block 315, heated nitrogen is injected through a first ring of perforated tubing to heat the surrounding area within the apparatus up to 60° F. At block 320, a second set of one or more temperature sensors measures the temperature of the surrounding area to ensure that the heated nitrogen is adequately heating to 60° F. At block 325, gas separated from the heterogeneous mixture passes through a second ring of perforated tubing in order to not allow the gas separated from the heterogeneous mixture to cool and crystallize. At block 330, a third set of one or more temperature sensors is used to measure the temperature of the surrounding area and a first density sensor is used to identify the gas phase just prior to reaching a gas regulator. At block 335, gas is passed through the gas regulator and a second density sensor checks to ensure that the gas is still in the gas phase prior to being sent to a gas riser. At block 340, the oil and water components of the heterogeneous mixture pass through a common port in order to enter an oil baffle chamber and a water baffle chamber, respectively. At block 345, density and pressure sensors within the oil baffle chamber and the water baffle chamber are monitored in order to control one or more oil regulators and one or more water regulators in order to achieve laminar flow and thus the homogeneous separation of the oil, water, and gas from the subsea wellhead and into an oil riser, a water riser, and the gas riser, respectively. Processing subsequently ends at 399.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

The benefits and advantages that may be provided by the present invention have been described above with regard to specific embodiments. These benefits and advantages, and any elements or limitations that may cause them to occur or to become more pronounced are not to be construed as critical, required, or essential features of any or all of the claims. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the claimed embodiment.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention as detailed within the following claims.

The invention claimed is:

1. An apparatus for capping a subsea wellhead, the apparatus comprising:

a housing having a bottom portion and a top portion;

an inlet riser having an opening at the bottom portion of the housing and extending through the bottom portion of the housing and into the top portion of the housing, wherein the inlet riser is configured to channel a heterogeneous mixture of oil, gas, and water spewing from the subsea wellhead into the apparatus;

a water baffle chamber within the bottom portion of the housing, wherein the water baffle chamber has one or more water chamber baffles, one or more water chamber density sensors, one or more water chamber pressure sensors, and one or more water outlets, wherein the one or more water chamber density sensors and the one or more water chamber pressure sensors monitor the interphase of the phases of the heterogeneous mixture in the water baffle chamber;

an oil baffle chamber within the top portion of the housing, wherein the oil baffle chamber has one or more oil chamber baffles, one or more oil chamber density sensors, one or more oil chamber pressure sensors, and one or more oil outlets, wherein the one or more oil chamber density sensors and the one or more oil chamber pressure sensors monitor the interphase of the phases of the heterogeneous mixture in the oil baffle chamber;

a common port between the bottom portion and the top portion of the housing, wherein the common port is configured to allow the oil access to the oil baffle chamber and to allow the water access to the water baffle chamber;

a top chamber positioned above the oil baffle chamber and within the top portion of the housing, wherein the top chamber has one or more gas outlets;

a gas regulator positioned between the top chamber and the inlet riser;

a first set of one or more temperature sensors within the inlet riser configured to measure an initial temperature of the heterogeneous mixture entering the apparatus through the inlet riser;

a first heater positioned above the first set of one or more temperature sensors and within the inlet riser, wherein the first heater is configured to raise the temperature of the heterogeneous mixture;

a second set of one or more temperature sensors positioned above the first heater and within the inlet riser, wherein the second set of one or more temperature sensors are configured to measure the temperature of the heterogeneous mixture after being heated by the first heater;

a second heater positioned above the common port and within the inlet riser, wherein the second heater is configured to heat the gas separated from the heterogeneous mixture;

a third set of one or more temperature sensors positioned above the second heater and within the inlet riser, wherein the third set of one or more temperature sensors are configured to measure the temperature of the gas after being heated by the second heater;

a first density sensor positioned below the gas regulator and within the inlet riser, wherein the first density sensor is configured to measure the density of the gas separated from the heterogeneous mixture; and a second density sensor within the top chamber, wherein the second density sensor is configured to measure the density of the gas which passes through the gas regulator to confirm that the gas is still in the gas phase prior to passing through the one or more gas outlets.

2. The apparatus of claim 1, wherein the first heater comprises:

a first heated nitrogen supply line;

a first perforated tubing coupled to the first heated nitrogen supply line; and a first regulator coupled to the first heated nitrogen supply line and configured to regulate the injection of heated nitrogen into the first heated nitrogen supply line.

3. The apparatus of claim 1, wherein the second heater comprises:

a second heated nitrogen supply line;

a second perforated tubing coupled to the second heated nitrogen supply line; and a second regulator coupled to the second heated nitrogen supply line and configured to regulate the injection of heated nitrogen into the second heated nitrogen supply line.

4. The apparatus of claim 1, the apparatus further comprising:

a common heated nitrogen supply line; and a common regulator coupled to the common heated nitrogen supply line and configured to regulate the injection of heated nitrogen into the common heated nitrogen supply line;

wherein the first heater comprises a first perforated tubing coupled to the common heated nitrogen supply line; and wherein the second heater comprises a second perforated tubing coupled to the common heated nitrogen supply line.

5. The apparatus of claim 1, the apparatus further comprising one or more water regulators coupled to the one or more water outlets.

6. The apparatus of claim 5, the apparatus further comprising one or more water risers coupled to the one or more water regulators.

7. The apparatus of claim 1, the apparatus further comprising one or more oil regulators coupled to the one or more oil outlets.

8. The apparatus of claim 7, the apparatus further comprising one or more oil risers coupled to the one or more oil regulators.

9. The apparatus of claim 1, the apparatus further comprising one or more gas regulators coupled to the one or more gas outlets.

10. The apparatus of claim 9, the apparatus further comprising one or more gas risers coupled to the one or more gas regulators.

11. The apparatus of claim 1, wherein the housing comprises carbon steel.

12. A method for capping a subsea wellhead, the method comprising:

channeling a heterogeneous mixture of oil, gas, and water spewing from the subsea wellhead into an inlet riser of a housing having a bottom portion and a top portion;

using a first set of one or more temperature sensors within the inlet riser to measure an initial temperature of the heterogeneous mixture;

using a first heater within the inlet riser to heat the heterogeneous mixture channeled into the inlet riser;

using a second set of one or more temperature sensors within the inlet riser to measure a post first heating temperature of the heterogeneous mixture to ensure heating of the heterogeneous mixture;

passing the heterogeneous mixture through a common port between the bottom portion and the top portion of the housing;

passing the heterogeneous mixture into an oil baffle chamber within the top portion of the housing, wherein the oil baffle chamber comprises one or more oil chamber baffles, one or more oil chamber density sensors, one or more oil chamber pressure sensors, one or more oil outlets, and one or more oil regulators coupled to the one or more oil outlets;

using the one or more oil chamber density sensors and the one or more oil chamber pressure sensors to monitor the interphase of the phases of the heterogeneous mixture in the oil baffle chamber;

passing the heterogeneous mixture into a water baffle chamber within the bottom portion of the housing, wherein the water baffle chamber comprises one or more water chamber baffles, one or more water chamber density sensors, one or more water chamber pressure sensors, one or more water outlets, and one or more water regulators coupled to the one or more water outlets;

using the one or more water chamber density sensors and the one or more water chamber pressure sensors to monitor the interphase of the phases of the heterogeneous mixture in the water baffle chamber;

using the monitoring of the interphase of the phases of the heterogeneous mixture to control the one or more oil regulators and the one or more water regulators to achieve substantially laminar flow and separation of the oil through the oil baffle chamber and the one or more oil regulators and the water through the water baffle chamber and the one or more water regulators;

using a second heater within the inlet riser to heat the gas separated from the heterogeneous mixture to prevent crystallization of the gas;

using a third set of one or more temperature sensors positioned above the second heater and within the inlet riser to measure the temperature of the gas after being heated by the second heater;

using a first density sensor positioned below a gas regulator and within the inlet riser to measure the density of the gas separated from the heterogeneous mixture and if in the gas phase, opening the gas regulator to allow the gas to pass from the inlet riser to a top chamber positioned above the oil baffle chamber and within the top portion of the housing, wherein the top chamber has one or more gas outlets and wherein the gas regulator is positioned between the top chamber and the inlet riser; and using a second density sensor within the top chamber to ensure the gas within the top chamber remains in the gas phase prior to allowing the gas to pass through the one or more gas outlets.

13. The method of claim 12, wherein the first heater comprises:

a first heated nitrogen supply line;

a first perforated tubing coupled to the first heated nitrogen supply line; and a first regulator coupled to the first heated nitrogen supply line and configured to regulate the injection of heated nitrogen into the first heated nitrogen supply line.

14. The method of claim 12, wherein the second heater comprises:

a second heated nitrogen supply line;

a second perforated tubing coupled to the second heated nitrogen supply line; and a second regulator coupled to the second heated nitrogen supply line and configured to regulate the injection of heated nitrogen into the second heated nitrogen supply line.

15. The method of claim 12, the method further comprising using one or more oil risers coupled to the one or more oil regulators to transport the oil to a containment vessel.

16. The method of claim 12, the method further comprising using one or more water risers coupled to the one or more water regulators to transport the water to a containment vessel.

17. The method of claim 12, the method further comprising using one or more gas risers coupled to one or more gas regulators coupled to the one or more gas outlets to transport the gas to a containment vessel.

18. The method of claim 12, wherein the housing comprises carbon steel.

* * * * *